US006176290B1

(12) United States Patent
Hsu

(10) Patent No.: US 6,176,290 B1
(45) Date of Patent: Jan. 23, 2001

(54) DEVICE FOR ADJUSTING SLATS OF VENETIAN BLIND

(75) Inventor: Peyson Hsu, Changhua Hsien (TW)

(73) Assignee: Ching Feng Blinds Ind Co., Ltd., Changhua Hsien (TW)

( * ) Notice: Under 35 U.S.C. 154(b), the term of this patent shall be extended for 0 days.

(21) Appl. No.: 09/427,664

(22) Filed: Oct. 27, 1999

(51) Int. Cl.[7] ..... E06B 9/26
(52) U.S. Cl. ..... 160/177 R; 160/115
(58) Field of Search ..... 160/177 R, 177 V, 160/176.1 R, 176.1 V, 168.1 R, 115

(56) References Cited

U.S. PATENT DOCUMENTS

| | | | | |
|---|---|---|---|---|
| 4,621,672 | | 11/1986 | Hsu . | |
| 4,657,061 | * | 4/1987 | Meier | 160/177 V X |
| 4,869,308 | * | 9/1989 | Chang | 160/115 X |
| 5,119,868 | * | 6/1992 | Werner | 160/115 |

* cited by examiner

*Primary Examiner*—David M. Purol

(74) *Attorney, Agent, or Firm*—Browdy and Neimark

(57) ABSTRACT

A device is designed to adjust slats of a Venetian blind and is formed of a seat fastened with one end of the upper rail of the Venetian blind. An upper worm rod and a lower worm rod are coaxially pivoted in seat such that the two worm rods are engaged with an upper worm wheel and a lower worm wheel, which are coupled with two cross shafts linking an upper slat group and a lower slat group of the Venetian blind. A movable stem has an upper segment which is located in the seat such the upper segment is engageable with the center holes of the two worm rods. The movable stem has a lower segment which is fastened with a control lever. The seat is further provided with a coil spring which is fitted over the movable stem such that the bottom end of the coil spring urges the seat, and that the top end of the coil spring urges the movable stem. The movable stem is provided with a driving portion. The center holes of the upper and the lower worm rods are provided with a retaining portion. When the movable stem is located at an upper stop point, the driving portion of the movable stem is retained in the retaining portion of the upper worm rod. When the movable stem is pulled by an external force, the driving portion of the movable stem is retained in the retaining portion of the lower worm rod.

3 Claims, 1 Drawing Sheet

DEVICE FOR ADJUSTING SLATS OF VENETIAN BLIND

FIELD OF THE INVENTION

The present invention relates generally to a Venetian blind, and more particularly to an improved device for adjusting the slats of the Venetian blind.

BACKGROUND OF THE INVENTION

The U.S. Pat. No. 4,621,672 issued to this inventor of the present invention discloses a horizontal Venetian blind comprising a plurality of upper slats and lower slats, whose bevels are separately controlled. The Venetian blind is provided with two sets of mechanisms to control the upper group of slats and the lower group of slats. The device comprises a movable stem 36 which is fastened at the top end thereof with the spring plate 40, and at the bottom end thereof with a hand operated lever 43. The movable stem 36 is provided with a gear 37 which is engaged with the internal gear 34*a* of the worm 34 for driving the worm wheel 32. At the time of the downward pulling, the gear 37 is engaged with the gear 35*a* of the worm rod 35 for driving the worm wheel 33. The worm wheels 32 and 33 are coupled with two shafts 21 and 22, which can be driven to turn at will. Such a prior art device as described above can not be produced in quantity at a low cost.

SUMMARY OF THE INVENTION

The primary objective of the present invention is to provide a Venetian blind with a device for adjusting slats of the Venetian blind in multiple steps. The device can be economically made in quantity.

In keeping with the principle of the present invention, the foregoing objective of the present invention is attained by a device comprising an upper rail which is provided at one end thereof with a seat. An upper worm rod and a lower worm rod are coaxially pivoted in the seat such that the two worm rods are engaged with an upper worm wheel and a lower worm wheel, which are coupled with two cross shafts. A movable stem has an upper segment which is located in the seat such that the upper segment is engageable with the center holes of the two worm rods, and that the lower segment is connected with a control lever. The seat is further provided with a coil spring which is fitted over the movable stem such that the bottom end of the coil spring urges the seat, and that the top end of the coil spring urges the movable stem. The movable stem is provided with a driving portion. The center holes of the upper worm rod and the lower worm rod are provided with a retaining portion in which the driving portion of the movable stem is retained at the time when the movable stem is located at the upper stop point. When the movable stem is pulled downward by an external force, the driving portion of the movable stem is retained in the retaining hole of the lower worm rod. When the movable stem is relieved of the external force exerting thereon, the movable stem is forced by the coil spring to return to the upper stop point.

DETAILED DESCRIPTION OF THE INVENTION

Figure 2:
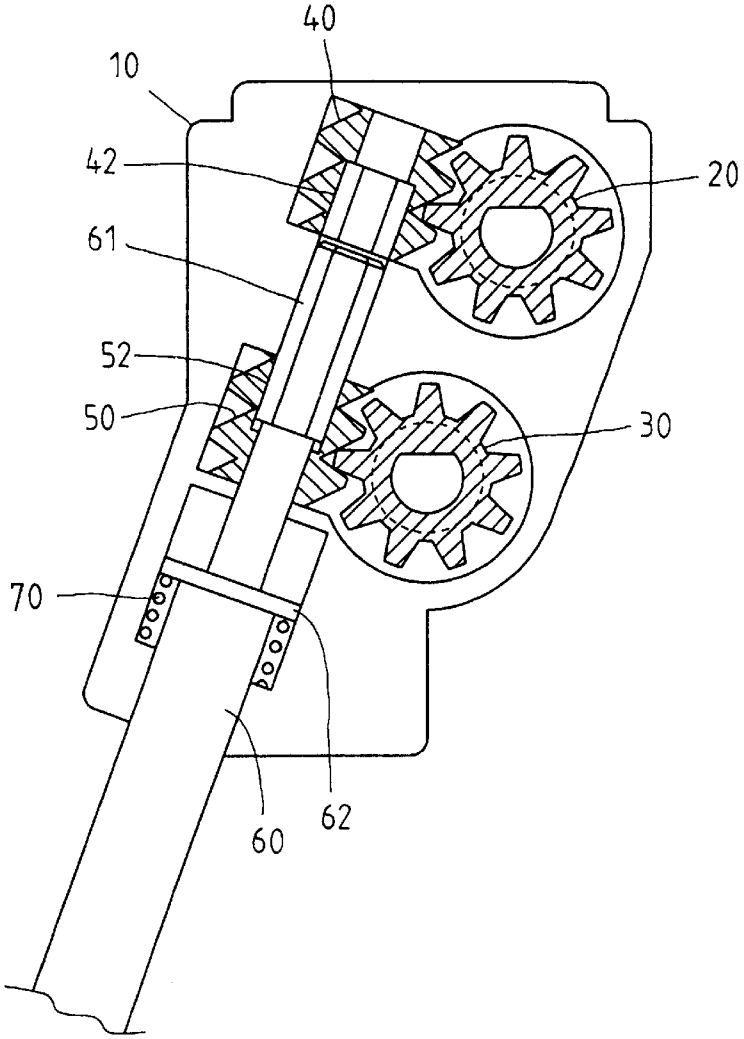
FIG. 2 is a side schematic view showing that the movable stem of the preferred embodiment of the present invention is exerted on by the external force.

The Venetian blind of the present invention is basically similar in construction to the prior art Venetian blind of the U.S. Pat. No. 4,621,672. The slats of the Venetian blind of the present invention are grouped into an upper slat group and a lower slat group, which are linked by two sets of regulating strings and are fastened with two cross shafts of the upper rail of the Venetian blind. The slats are actuated to turn slantingly by the cross shafts in motion.

The device of the present invention comprises a seat 10, an upper worm wheel 20, a lower worm wheel 30, an upper worm rod 40, a lower worm rod 50, a movable stem 60, and a coil spring 70.

The seat 10 is fastened with one end of the upper rail of the Venetian blind and is formed of two shell members. The seat 10 has an interior which is provided with an upper worm rod chamber 11, a lower worm rod chamber 12, a spring chamber 13, a passage 14 in communication with the two worm rod chambers 11 and 12 and the spring chamber 13, an upper worm wheel chamber 15 contiguous to the upper worm rod chamber 11, and a lower worm wheel chamber 16 contiguous to the lower worm rod chamber 12. The two worm wheel chambers 15 and 16 are provided with two through holes 17 which are located at both ends of the horizontal direction of the chamber 15 or 16.

The two worm wheels 20 and 30 are respectively disposed in the upper and the lower worm wheel chambers 15 and 16 such that the pivoting portions 31 of both ends of the worm wheels 20 and 30 are pivoted to the through holes 17. Each worm wheel has an insertion hole 32 for use in coupling the worm wheel with the cross shafts. The cross shafts are actuated to turn by the worm wheels in motion.

The two worm rods 40 and 50 are pivotally disposed in the two worm rod chambers 11 and 12 such that the two worm rods 40 and 50 are engaged with the two worm wheels 20 and 30. The two worm rods 40 and 50 are provided with a center hole 41 (51). The center hole 41 of the upper worm rod 40 is provided at the bottom end thereof with a retaining portion 42. The center hole 51 of the lower worm rod 50 is provided at the top end thereof with a retaining portion 52.

The movable stem 60 has an upper segment, which is extended into the seat 10 via the passage 14 such that the upper segment penetrates the lower worm rod 50 and the upper worm rod 40. The movable stem 60 is provided at the top end thereof with a driving portion 61 of a hexagonal construction. The movable stem 60 is further provided with a contact portion 62 which is of a circular platelike construction and is located in the spring chamber 13. The movable stem 60 has a lower segment, which is located in the outside of the seat 10 and is fastened with a control lever.

The coil spring 70 is disposed in the spring chamber 13 such that the coil spring 70 is fitted over the movable stem 60. The bottom end of the coil spring 70 urges the bottom wall of the spring chamber 13, whereas the top end of the coil spring 70 urges the contact portion 62 of the movable stem 60. The movable stem 60 can be pushed upward by the coil spring 70 such that the contact portion 62 of the movable stem 60 presses against the top wall of the spring chamber 13.

Figure 1:
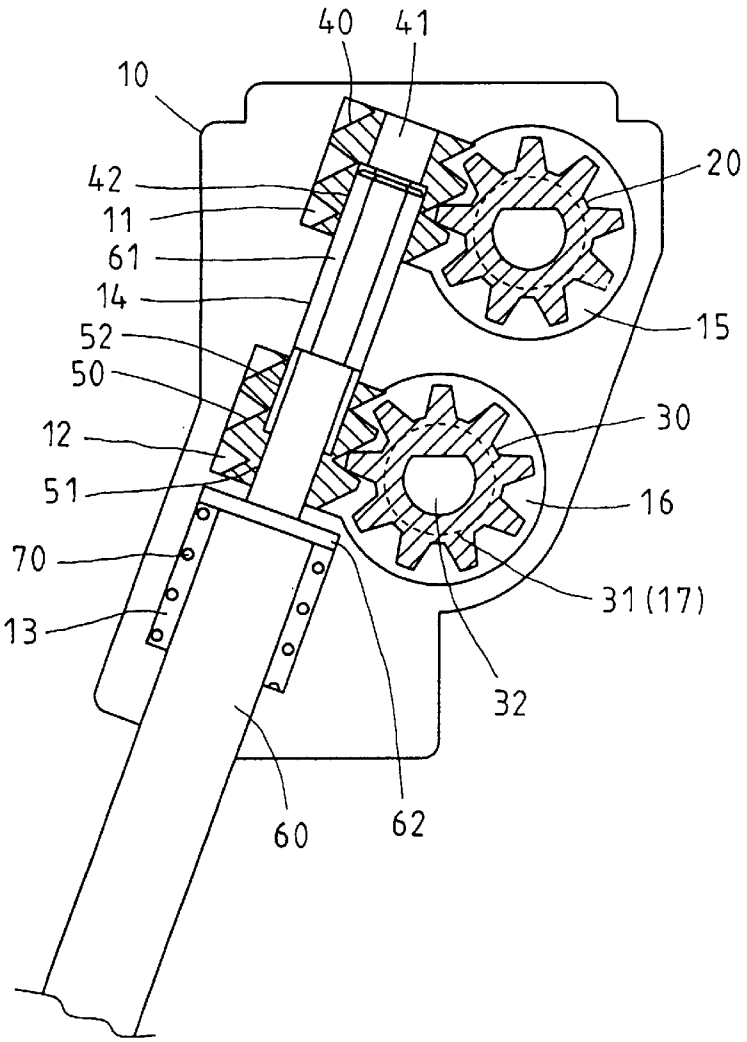
FIG. 1 is a side schematic view showing that the movable stem of a preferred embodiment of the present invention is not exerted on by an external force.

As shown in FIG. 1, when the movable stem 60 is not exerted on by an external force, the movable stem 60 is urged by the coil spring 70 to remain at an upper stop point such that the driving portion 61 of the movable stem 60 is retained in the retaining portion 42 of the upper worm rod

40. As a person turns the control lever, the movable stem 60 is actuated to turn so as to drive the upper worm rod 40. As a result, the upper worm wheel 20 is driven by the upper worm rod 40 to turn. In the meantime, the lower worm rod 50 remains inactivated. When the control lever is pulled downward by the person, the movable stem 60 is drawn to slide downward such that the driving portion 61 of the movable stem 60 moves out of the retaining portion 42 in which the driving portion 61 is retained, and that the lower segment of the movable stem 60 is retained in the retaining portion 52 of the lower worm rod 50, as shown in FIG. 2. If the movable stem 60 is actuated to turn under such a circumstance, the lower worm rod 50 is actuated to drive the lower worm wheel 30. When the movable stem 60 is relieved of the external force exerting thereon, the movable stem 60 is pushed upward by the coil spring 70 to return to the original position thereof, as shown in FIG. 1.

It is therefore readily apparent that the device of the present invention is simple in construction and is user-friendly. When a person desires to adjust the angle at which the upper slat group of the Venetian blind is set together, the person simply turns the control lever to actuate the upper worm wheel 20 to turn, thereby resulting in one of the two cross shafts being driven by the upper worm wheel 20 to turn. On the other hand, if the person desires to adjust the angle at which the lower slat group of the Venetian blind is set together, the person simply turns the control lever which is simultaneously pulled downward. As a result, other one of the two cross shafts is driven by the lower worm wheel 30 to turn.

What is claimed is:

1. A device for adjusting an upper slat group and a lower slat group of a Venetian blind, with the upper slat group being linked with one of two cross shafts which are fastened pivotally with an upper rail of the Venetian blind, and with the lower slat group being linked with other one of the two cross shafts, said device comprising:

a seat fastened with one end of the upper rail of the Venetian blind;

an upper worm wheel and a lower worm wheel, which are pivoted to said seat and are coupled respectively with the two cross shafts; an upper worm rod and a lower worm rod, which are pivoted to said seat and are respectively engaged with said upper worm wheel and said lower worm wheel, said upper worm rod and said lower worm rod being provided with a center hole whereby said center hole is provided with a retaining portion;

a movable stem having an upper segment which is located in said seat and is engageable with said center holes of said upper worm rod and said lower worm rod, said upper segment being provided with a driving portion and a contact portion, said movable stem further having a lower segment which is located in the outside of said seat and is fastened with a control lever; and a coil spring disposed in said seat and fitted over said movable stem such that one end of said coil spring urges said seat, and that other end of said coil spring urges said contact portion of said movable stem, and further that said coil spring pushes said movable stem to locate at an upper stop point;

said driving portion of said movable stem being retained in said retaining portion of said upper worm rod at such time when said movable stem is located at said upper stop point, said driving portion of said movable stem being retained in said retaining portion of said lower worm rod at such time when said movable stem is pulled by an external force.

2. The device as defined in claim 1, wherein said seat is provided in an interior thereof with an upper worm rod chamber to house said upper worm rod, a lower worm rod chamber to house said lower worm rod, an upper worm wheel chamber to house said upper worm wheel, a lower worm wheel chamber to house said lower worm wheel, a spring chamber to house said coil spring, and a passage in communication with said two worm rod chambers and said spring chamber; and wherein said movable stem is disposed in said passage such that said contact portion of said movable stem is located in said spring chamber, and that said contact portion of said movable stem can press against a top wall of said spring chamber.

3. The device as defined in claim 2, wherein said driving portion of said movable stem is of a polygonal shape and is located at a top end thereof; wherein said retaining portion of said upper worm rod is located at a lower end of said center hole of said upper worm rod and is corresponding in shape to said driving portion of said movable stem; and wherein said retaining portion of said lower worm rod is located at an upper end of said center hole of said lower worm rod and is corresponding in shape to said driving portion of said movable stem.

* * * * *